US007458190B2

(12) United States Patent
Isaac et al.

(10) Patent No.: US 7,458,190 B2
(45) Date of Patent: Dec. 2, 2008

(54) EXTRUDED CONNECTING PROFILE

(75) Inventors: Eric Isaac, Moutfort (LU); Paolo Cortivo, Treviso (IT); Piergiorgio Polloni, Treviso (IT); Stefano Gabriel, Treviso (IT)

(73) Assignee: Hilltech Holdings S.A., Luxembourg (LU)

( * ) Notice: Subject to any disclaimer, the term of this patent is extended or adjusted under 35 U.S.C. 154(b) by 757 days.

(21) Appl. No.: 10/480,671

(22) PCT Filed: Mar. 23, 2002

(86) PCT No.: PCT/EP02/03293

§ 371 (c)(1),
(2), (4) Date: May 19, 2004

(87) PCT Pub. No.: WO02/101165

PCT Pub. Date: Dec. 19, 2002

(65) Prior Publication Data

US 2004/0200167 A1 Oct. 14, 2004

(30) Foreign Application Priority Data

Jun. 12, 2001 (LU) ..... 90786

(51) Int. Cl.
*E04B 1/686* (2006.01)

(52) U.S. Cl. ..... 52/396.03; 52/578; 52/772

(58) Field of Classification Search ..... 52/393, 52/396.03, 578, 656.1, 287.1, 716.8, 16.8, 52/772, 271, 275, 254, 573.1; 403/291, 220; 404/87, 48, 74

See application file for complete search history.

(56) References Cited

U.S. PATENT DOCUMENTS

| | | | | | |
|---|---|---|---|---|---|
| 517,701 | A | * | 4/1894 | Knower | 52/393 |
| 3,334,558 | A | * | 8/1967 | Atkinson | 404/87 |
| 3,350,828 | A | * | 11/1967 | Russell | 52/395 |
| 3,707,060 | A | * | 12/1972 | Jansen, Jr. | 52/241 |
| 3,709,115 | A | * | 1/1973 | Brown | 404/65 |
| 3,989,397 | A | * | 11/1976 | Baker | 403/205 |
| 4,166,332 | A | * | 9/1979 | Donovan | 40/605 |
| 4,322,572 | A | * | 3/1982 | Snyder | 174/368 |
| 4,385,850 | A | * | 5/1983 | Bobath | 403/205 |
| 4,468,067 | A | * | 8/1984 | Jenkins | 312/140 |
| 4,585,131 | A | * | 4/1986 | Crossman et al. | 211/206 |

(Continued)

FOREIGN PATENT DOCUMENTS

DE 29700361 3/1997

(Continued)

*Primary Examiner*—Richard E. Chilcot, Jr.
*Assistant Examiner*—Anthony N Bartosik
(74) *Attorney, Agent, or Firm*—McCormick, Paulding & Huber LLP

(57) ABSTRACT

An extruded connecting profile for two panels having peripheral edges includes a first frame element having a front side and an opposite rear side, the front side being shaped for engaging a peripheral edge of a first panel of the two panels. A second frame element is also provided having a front side and an opposite rear side the front side being shaped for engaging a peripheral edge of a second panel of the two panels. An elastic structure extending between the first and second frame elements is co-extruded with the first and second frame elements and is comprised of a material having a higher elasticity than the material of the first and second frame elements.

8 Claims, 4 Drawing Sheets

U.S. PATENT DOCUMENTS

| | | | | | |
|---|---|---|---|---|---|
| 4,651,488 | A | * | 3/1987 | Nicholas et al. | 52/396.02 |
| 4,664,349 | A | * | 5/1987 | Johansen et al. | 248/150 |
| 4,913,576 | A | * | 4/1990 | Grant, Jr. | 403/13 |
| 4,968,105 | A | * | 11/1990 | Schaars | 312/140 |
| 5,042,211 | A | * | 8/1991 | Nestler | 52/396.06 |
| 5,203,640 | A | | 4/1993 | Pourtau et al. | |
| 5,289,663 | A | * | 3/1994 | Schluter | 52/287.1 |
| 5,398,468 | A | * | 3/1995 | Erickson | 52/282.3 |
| 5,444,953 | A | * | 8/1995 | Koenig et al. | 52/282.1 |
| 5,531,455 | A | * | 7/1996 | Calixto | 277/646 |
| 5,771,652 | A | * | 6/1998 | Nagata et al. | 52/716.5 |
| 5,803,146 | A | * | 9/1998 | Boon | 160/135 |
| 6,030,020 | A | * | 2/2000 | Malm | 296/93 |
| 6,209,275 | B1 | * | 4/2001 | Cates et al. | 52/283 |
| 6,318,039 | B1 | * | 11/2001 | Watson et al. | 52/288.1 |
| 6,991,400 | B1 | * | 1/2006 | Negueloua | 404/56 |
| 7,090,226 | B1 | * | 8/2006 | Trainor et al. | 277/630 |

FOREIGN PATENT DOCUMENTS

| | | |
|---|---|---|
| DE | 29809264 | 10/1998 |
| EP | 0644337 | 3/1995 |
| WO | WO 95/32343 | 11/1995 |

* cited by examiner

EXTRUDED CONNECTING PROFILE

CROSS-REFERENCE TO RELATED APPLICATIONS

This application is entitled to the benefit of and incorporates by reference in their entireties essential subject matter disclosed in International Application No. PCT/EP02/03293 filed on Mar. 23, 2002 and Luxembourg Patent Application No. 90 786 filed on Jun. 12, 2001.

FIELD OF THE INVENTION

The present invention generally relates to an extruded connecting profile for two panels, in particular for panels of a movable wall structure

BACKGROUND OF THE INVENTION

So called movable wall structures are conventionally used in order to divide large enclosed spaces into a plurality of smaller rooms or to cover walls. They are substantially constituted by frameworks composed of uprights, which are secured between the ceiling and the floor, by possible cross-members arranged between pairs of uprights, and by panels which are applied and secured to the uprights in various manners. The panels may be made of an opaque material, e.g. wood or synthetic material, or of a transparent material, such as e.g. glass or Plexiglas®.

When building a large partition, a number of panels are assembled end to end between two uprights. In such a case, it is desirable to avoid gaps between two adjacent panels, for aesthetic and insulation reasons. Therefore, a connecting profile is generally inserted between the adjacent peripheral edges of two successive panels. However, depending on the manufacturing tolerances, the size of the panels may vary from one panel to another, whereby the size of the gap between two panels may also vary. This is a recurrent problem, which complicates the assembly of such structures, since the connecting profiles provided for the panels of a given structure are generally of a single type with a unique thickness.

WO 95/32343 describes a modular partition system wherein adjacent edges of two neighbouring panels are assembled by means of coextruded, siamesed frame members. Such siamesed frame members consist of two identical frame members, which are U-shaped in cross-section, and each have a bottom transverse wall and a pair of upstanding parallel side walls in a spaced apart relationship defining therebetween a longitudinally extending channel for engaging a respective edge of a panel. A flexible web interconnects the siamesed frame members, and constitutes a hinge allowing to locate the frame members at different angular relationships The flexible web is arranged in such a way as to not line up with the mouths of the channels, so that it forms a recess between the flexible web and the bottom walls of the frame members, that closely conforms to the outer configuration of a third, identical frame member, that can be nested therebetween to assemble panels in a T-shaped configuration.

OBJECT AND SUMMARY OF THE INVENTION

Hence, there is a need for a connecting profile that can be easily mounted in-between two panels, even if the size of the gap may vary. This object is achieved by an extruded connecting profile in accordance with the present invention.

According to a first aspect of the invention, an extruded connecting profile for two panels is proposed. It comprises a first frame element having a front side and an opposite rear side, the front side being shaped for engaging a peripheral edge of the first panel. A second frame element has a front side and an opposite rear side, the front side being shaped for engaging a peripheral edge of the second panel, which is adjacent to the peripheral edge of the first panel. The extruded connecting profile further comprises an elastic structure extending between the first and second frame elements. This elastic structure is co-extruded with the first and second frame elements and consists of a material having a higher elasticity than the material of the first and second frame elements.

The extruded connecting profile according to the invention thus has two rigid frame elements engaging the adjacent peripheral edges of two successive panels, and has an elastic structure. The elasticity of this elastic structure allows compression of the connecting profile, while the rigid frame elements remain in engagement with the panels. It follows that the present connecting profile can adapt to the size of the gap between the two panels. The connecting profile is particularly suited to be used in a movable wall structure, where it can connect either wall panels or window panels Furthermore, the manufacturing of the present connecting profile is carried out by a co-extrusion process, which is relatively simple and quick.

The first and second frame elements are essentially parallel to each other. The elastic structure comprises two transverse webs, each of them joining the rear side of the first frame element to the rear side of the second frame element. The connecting profile is thus particularly adapted for connecting the peripheral edges of two aligned, successive panels.

The transverse webs of the elastic structure are advantageously symmetrically arranged, so as to ensure a homogenous deformation of the elastic structure.

Each of the first and second frame elements are preferably provided with a pair of longitudinal profiled border elements, which each define a border surface on the front sides of the frame elements, so that the front sides are better adapted to engage the peripheral edges of the panels. In case the peripheral edges of the first and second panels comprise chamfered corners, the profiled border elements should each define an oblique border surface, so that the front sides are better adapted to engage the chamfered corners.

Each of the profiled border elements may further comprise a lip protruding on the rear side of the first frame element, respectively the second frame element. For example, the lips of the profiled border elements of the first frame element may be adapted to engage with the lips of the profiled border elements of the second frame element, when said sealing strip is compressed. Alternatively, the lips may be configured in such a way as to come into abutment against each other in the maximal compressed state of the connecting profile.

As explained herein before, the frame elements are made of a more rigid material than the elastic structure. A variety of materials, namely synthetic materials, are suitable either for the frame elements or for the elastic structure. However, the elastic structure is preferably made of an olefin thermoplastic polymer. Regarding the frame elements, preferred materials are polymethyl methacrylate and polycarbonates.

According to a second aspect of the invention, an extruded connecting profile for a multiple panel structure is proposed. It comprises a first extruded connecting profile according to the first aspect of the invention to be mounted between a first pair of adjacent panels. It further comprises a second extruded connecting profile according to the first aspect of the invention to be mounted between a second pair of adjacent panels, parallel to the first pair of panels and spaced therefrom. A spacing structure connects the first extruded connecting profile and the second extruded connecting profile in-between the first and second pairs of panels. In a preferred embodiment, the spacing structure is connected at one end to a first frame element of the first connecting profile and is connected at the other end to a first frame element of the second connecting profile.

The spacing structure is preferably made of a rigid material, such as that of the frame elements.

The connecting profile according to the second aspect of the invention is particularly adapted for a movable wall structure with double walls. It allows for connection between adjacent panels, with a variable gap size. Moreover, the rigidity of the spacing structure enables a proper spacing of the panels rows, which ensures a flat surface of the movable wall structure.

According to a third aspect of the invention, an extruded corner profile for two panels forming a corner is proposed. The extruded corner profile comprises a first frame element having a front side and an opposite rear side, the front side being shaped for engaging an outer edge portion of a peripheral edge of the first panel. It also comprises a second frame element having a front side and an opposite rear side, the front side being shaped for engaging an outer edge portion of a peripheral edge of the second panel, the peripheral edge of the second panel being adjacent to the peripheral edge of the first panel. The extruded corner profile further includes a central frame element in-between the first and second frame elements. This central frame element has, about an inner end thereof, a longitudinal retaining border element for engaging inner edge portions of the peripheral edges of the first and second panels. Furthermore, the first and second frame elements are each connected to the central frame element by means of connecting webs co-extruded with the first, second and central frame elements. Moreover, the connecting webs are made of a material having a higher elasticity than that of the first, second and central frame elements.

The elasticity of the connecting webs allows compression of the connecting profile between the inner edge portions of the panels, while the rigid frame elements remain in engagement with the outer edge portions of the panels. It follows that the present connecting profile can adapt to the size of the gap between the peripheral edges of the two panels.

Generally, the peripheral edges of said first and second panels will comprise chamfered corners. Hence, each of the first and second frame elements may comprise a longitudinal profiled border element adapted to engage a chamfered outer edge portion of the panels.

Besides, each of the longitudinal profiled border elements of the first and second frame elements may comprise a lip protruding on the rear side of the first frame element, respectively the second frame element. The central frame element may thus comprise a longitudinal profiled border element opposite the inner end, having a first lip protruding towards the border element of the first frame element and a second lip protruding towards the border element of the second frame element. These lips shall be configured in such a way as to engage with each other when the corner profile is compressed.

BRIEF DESCRIPTION OF THE DRAWINGS

The present invention will now be described, by way of example, with reference to the accompanying drawings, in which.

In the Figures, same reference numbers indicate similar or identical elements.

DETAILED DESCRIPTION OF A PREFERRED EMBODIMENT

Figure 1:
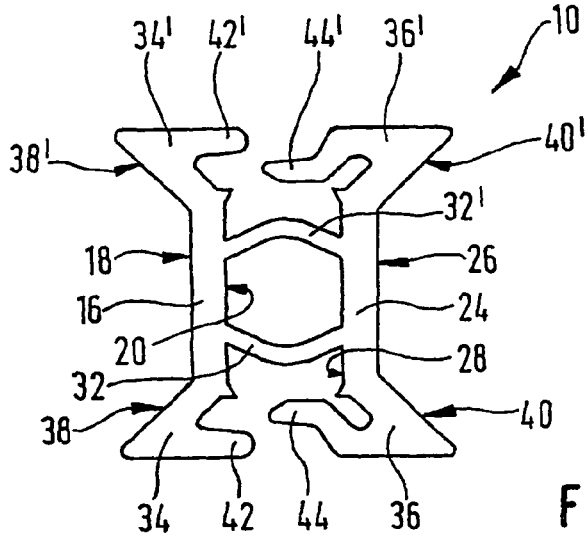
FIGS. 1 to 3: are sectional views of a first embodiment of an extruded connecting profile according to the invention.
Figure 2:
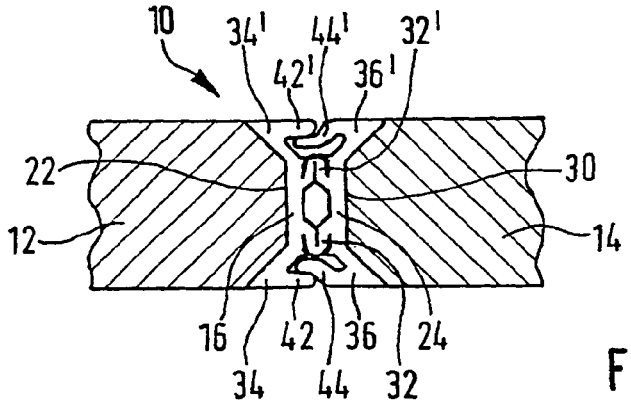
Figure 3:
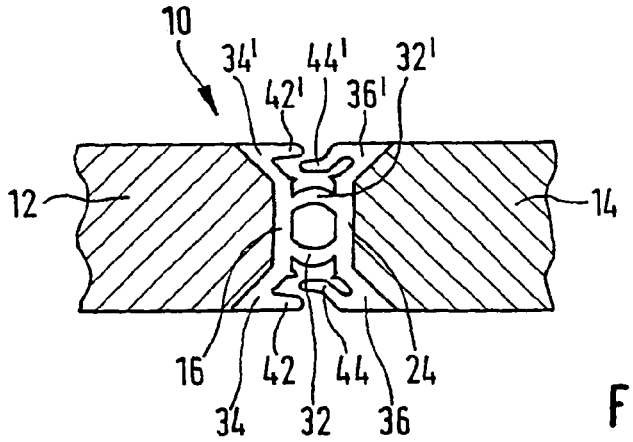

FIGS. 1 to 3 show sectional views of a first embodiment of an extruded connecting profile 10 in accordance with the invention, the connecting profile 10 being mounted in a gap between two panels 12 and 14 of a movable wall structure in FIGS. 2 and 3. These two panels may be made of a translucent material (e.g. glass or Plexiglas®) or of an opaque material (e.g. wood or synthetic material). The connecting profile 10 comprises a first frame element 16 having a front side 18 and an opposite rear side 20, the front side 18 being shaped for engaging a peripheral edge 22 of the first panel 12. Reference sign 24 indicates a second frame element, essentially parallel to the first frame element 16, which has a front side 26 and an opposite rear side 28. The front side 26 of this second frame element 24 is shaped for engaging a peripheral edge 30 of the second panel 14, which is adjacent to the peripheral edge 22 of the first panel 16. The connecting profile 10 further comprises an elastic structure extending between the first 16 and second 24 frame elements. In the embodiment shown in FIGS. 1 to 3, the elastic structure comprises two transverse webs 32 and 32', each of them joining the rear side 20 of the first frame element 16 to the rear side 28 of the second frame element 24. These transverse webs 32 and 32' are co-extruded with the first 16 and second 24 frame elements and consist of a material having a higher elasticity than the material of the first 16 and second 24 frame elements. As can be seen, the transverse webs 32 and 32' are advantageously symmetrically arranged so as to ensure a homogeneous deformation of the connecting profile 10.

The elastic structure of the connecting profile 10 allows the latter to easily adapt to gaps of various sizes. In FIG. 3, the connecting profile 10 is shown in its minimal compression state, i.e. the elastic structure is almost not compressed. In FIG. 2, the connecting profile 10 is shown in its maximal compression state. Since the first frame element 16 and second frame element 24 are more rigid than the elastic structure, they are essentially not deformed and remain in proper engagement with the peripheral edges 22 and 30 when the size of the gap is reduced, whereas the elastic structure is compressed.

As can be seen in FIGS. 1 to 3, each of the first 16 and second 24 frame elements has a pair of longitudinal profiled border elements indicated 34 and 34', respectively 36 and 36'. Each of these profiled border elements 34, 34', 36 and 36' defines an oblique border surface 38, 38', 40 and 40' on their respective front sides 18 and 26. The front sides 18 and 26 are thus adapted to engage the chamfered corners of the peripheral edges 22 and 30 of the panels 12 and 14.

Furthermore, each of the profiled border elements 34, resp. 34', of the first frame element 16 are provided with a short lip 42, resp. 42', protruding on the rear side 20 thereof. The profiled border elements 36 and 36' of the second frame element 24 are each provided with an extended lip 44, resp. 44', protruding on the rear side 28 thereof. These extended lips 44 and 44' of the second frame element 24 are configured in such a way as to engage with the short lips 42 and 42' on the first frame element 16 when the connecting profile 10 is compressed, as shown in FIG. 2.

Figure 4:
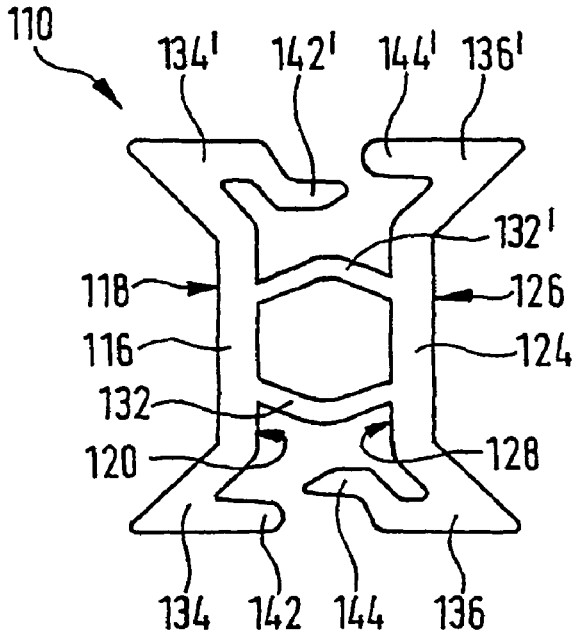
FIG. 4: is a sectional view of a second embodiment of an extruded connecting profile according to the invention.

Turning now to FIG. 4, a sectional view of a second embodiment of an extruded connecting profile 110 is shown, which is similar to the connecting profile 10 of FIG. 1. The connecting profile 110 comprises a first frame element 116 having a front side 118 and an opposite rear side 120, the front side 118 being shaped for engaging a peripheral edge of a first panel (not shown). Reference sign 124 indicates a second frame element, essentially parallel to the first frame element 116, which has a front side 126 and an opposite rear side 128. The front side 126 of this second frame element 124 is shaped for engaging an adjacent peripheral edge of a second panel (not shown). The connecting profile 110 further comprises an elastic structure, preferably formed by a pair of transverse webs 132 and 132' joining the rear side 120 of the first frame element 116 to the rear side 128 of the second frame element 124. These transverse webs 132 and 132' are co-extruded with the first frame element 116 and the second frame element 124 and are made of a material having a higher elasticity than the material of the first 116 and second 124 frame elements.

As for the first embodiment of FIG. 1, the connecting profile 110 of FIG. 4 is provided with a pair of profiled border elements 134 and 134', resp. 136 and 136', on each of the frame elements 116 and 124 respectively. In contrast to FIG. 1, each of the frame elements 116, resp. 124, of the connecting profile 110 is provided with a short lip 142, resp. 144', and with an extended lip 142', resp. 144, which protrude on the rear side 120, resp. 128, of their respective frame element 116, 124. Here again, these lips 142, 142', 144 and 144' are configured in such a way that the extended lips 142' and 144 engage with the corresponding short lips 142 and 144' when the connecting device 110 is compressed.

Figure 5:
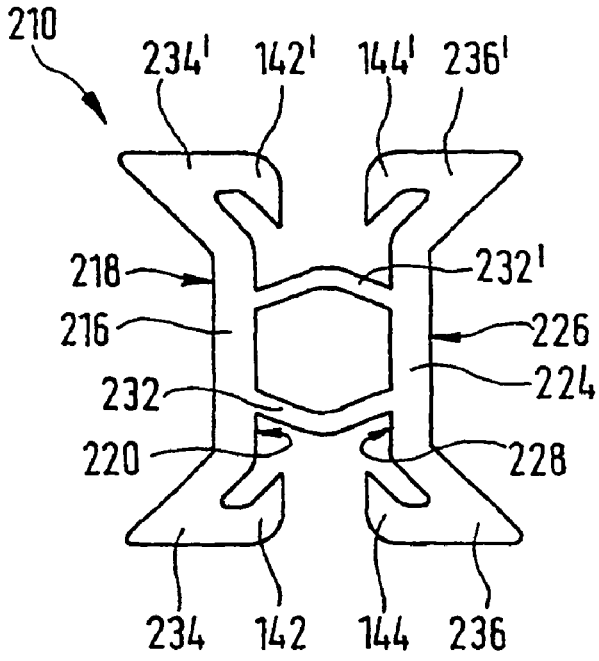
FIG. 5: is a sectional view of a third embodiment of an extruded connecting profile according to the invention.

In FIG. 5, is shown a sectional view of third embodiment of an extruded connecting profile 210. The connecting profile 210 comprises a first frame element 216 having a front side 218 and an opposite rear side 220, the front side 218 being shaped for engaging a peripheral edge of a first panel (not shown). Reference sign 224 indicates a second frame element, essentially parallel to the first frame element 216, which has a front side 226 and an opposite rear side 228. The front side 226 of this second frame element 224 is shaped for engaging an adjacent peripheral edge of a second panel (not shown). The connecting profile 210 further comprises an elastic structure, preferably formed by a pair of transverse webs 232, 232' joining the rear side 220 of the first frame element 216 to the rear side 228 of the second frame element 224. These transverse webs 232 and 232' are co-extruded with the first and second frame elements 216, 224 and are made of a material having a higher elasticity than the material of the first 216 and second 224 frame elements.

Furthermore, the connecting profile 210 of FIG. 5 is provided with a pair of profiled border elements 234 and 234', resp. 236 and 236', on each of the frame elements 216 and 224 respectively. Each of the border elements 234, 234', 236, 236' is provided with a curved lip 142, 142', 144, 144' protruding on the rear side of the respective frame elements. The curved lips 142, 142' of the first frame element 116 come into abutment with the curved lips 144, 144' of the second frame element 224 when the connecting profile 210 is approximately compressed to its maximal state.

Figure 6:
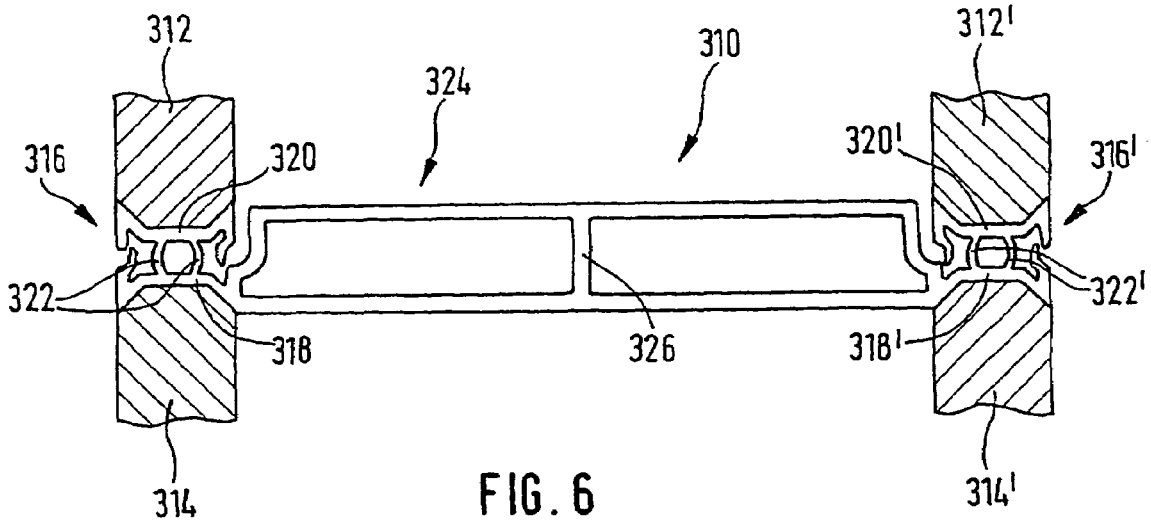
FIG. 6: is a sectional view of a preferred embodiment of a connecting profile for a double walled structure.

Turning now to FIG. 6, a preferred embodiment of an extruded connecting profile 310 for a double-walled movable wall structure is shown. Reference sign 312 and 314 indicate a first pair of aligned, successive panels and reference signs 312' and 314' indicate a second pair of aligned successive panels, parallel to the first pair 312, 314 and spaced therefrom.

The extruded connecting profile 310 comprises a first and a second connecting profile, indicated 316 and 316', which are similar to the connecting profile of FIG. 4. Accordingly, these connecting profiles 316 and 316' each comprise a first frame element 318, resp. 318', and a second frame element 320, resp. 320', and an elastic structure, extending between the frame elements. The elastic structure of each connecting profile 316, resp. 316', consists of a pair of transverse webs 322, resp. 322'.

Reference sign 324 indicates a spacing structure joining the first frame element 318 of the first connecting profile 316 to the first frame element 318' of the second connecting profile 316' in-between the two pairs of panels 312, 314 and 312', 314'. This spacing structure 324 is advantageously made of the same rigid material as the first frame elements 318 and 318' and second frame elements 320 and 320'. In the shown embodiment, the spacing structure 324 is an essentially rectangular frame, with a central reinforcing web 326.

Figure 7:
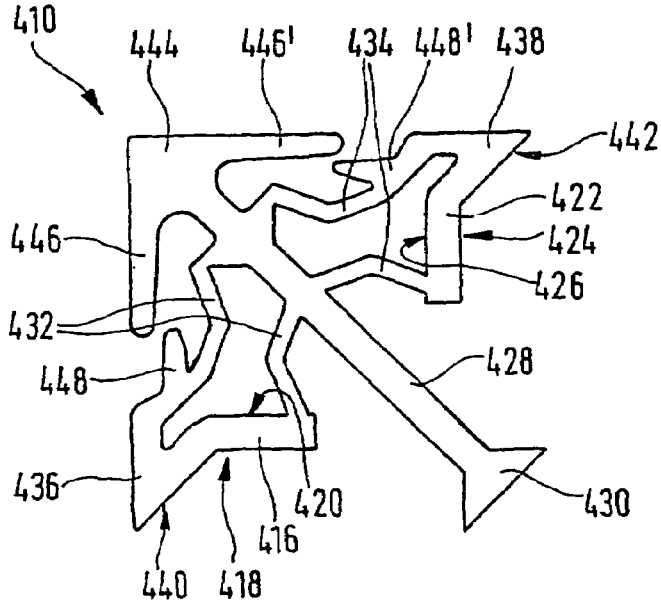
FIG. 7 to 9: are sectional views of a preferred embodiment of a corner profile.

The connecting profiles shown in FIGS. 1 to 5 are particularly adapted for connecting two successive panels which are essentially aligned. When two panels forming a corner are to be connected, the extruded corner profile 410 shown in FIG. 7 can be used. This corner profile 410 is particularly adapted for two panels 412 and 414 disposed at right angle, see FIG. 8. These panels thus define an inner angle, indicated A1. Accordingly, the part of the peripheral edge of a panel on the side of this inner angle may be called inner edge portion, whereas the part of the peripheral edge opposed to the inner edge portion may be called outer edge portion. The first and second panels 412, resp. 414, thus each have an inner edge portion 412', resp. 414', and an outer edge portion 412", resp. 414".

This extruded corner profile 410 comprises a first frame element 416 having a front side 418 and an opposite rear side 420. The front side 418 is shaped for engaging the outer edge portion 412" of the peripheral edge of the first panel 412, see FIG. 8. Reference sign 422 indicates a second frame element having a front side 424 and an opposite rear side 426. The first frame element 416 and the second frame element 422 are perpendicularly arranged with respect to each other. The front side 424 of the second frame element 422 is shaped for engaging the outer edge portion 414" of the peripheral edge of the second panel 414.

The corner profile 410 further comprises a central frame element 428 lying in a bisecting plane of the angle A1 defined by the panels 412 and 414. It includes, about its inner end, a longitudinal retaining border element 430 for engaging the inner edge portions 412' and 414' of the peripheral edges of the first and second panels 412 and 414.

Furthermore, the first and second frame elements 416, 422 are each connected to the central frame element 428 by means of a pair of connecting webs 432, 434. The pairs of connecting webs 432, 434 are co-extruded with the first 416, second 422 and central 428 frame elements and are made of a material having a higher elasticity than that of the first 416, second 422 and central 428 frame elements.

Figure 8:
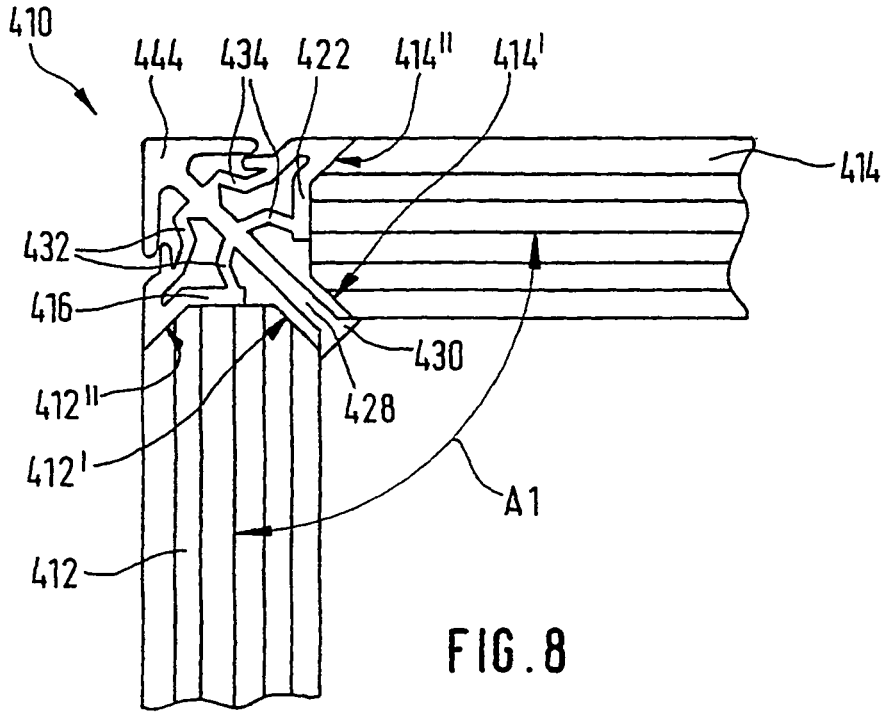
Figure 9:
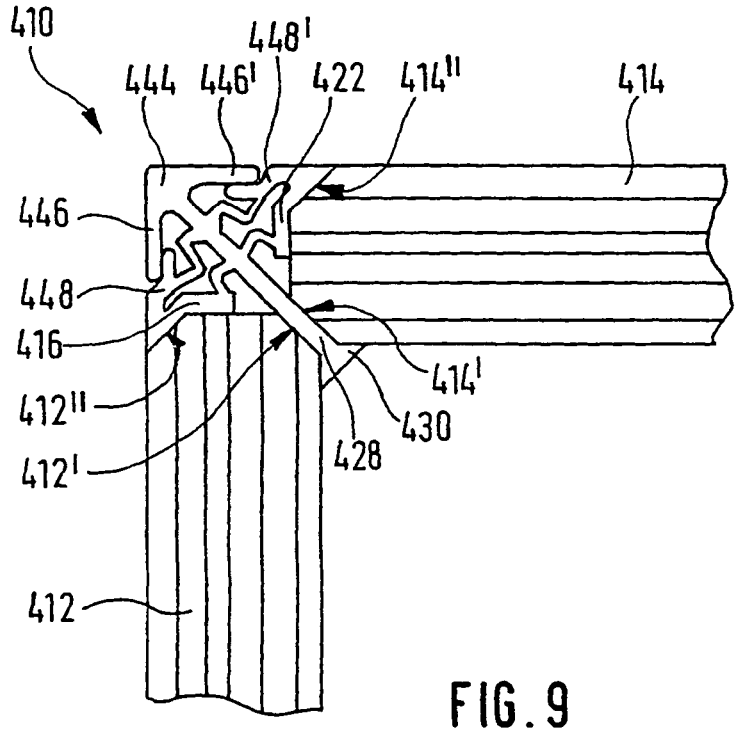

Each of the two frame elements 416 and 422 has a longitudinal profiled border 436, resp. 438, which defines an oblique border surface 440, resp. 442, so as to obtain a proper engagement with the chamfered shape of the outer edge portions 412", resp. 414", of the peripheral edges of the panels 412 and 414. As can be seen in FIGS. 8 and 9, the inner edge portion 412', 414' of each panel is in abutment against the retaining border element 430 of the central frame element 428, whereas the outer edge portion 412", 414" of each panel is in abutment against a frame element 416, resp. 422.

Such a structure allows the corner profile 410 to adapt to the size of the gap between the two panels. In FIG. 9, the corner profile 410 is shown in its maximal compression state. The inner edge portions 412' and 414' of the panels are completely applied onto the central frame element 428. The corner profile is kept in place since the central frame element 428 is pressed between the inner edge portions 412', 414'. In FIG. 8, the gap between the peripheral edges of the panels 412 and 414 is larger. As can be seen, the inner edge portions 412', 414' are only in contact with the retaining border element 430, which is sufficient for ensuring that the corner profile 410 is kept in place, and the frame elements 416 and 422 are properly engaged with the outer edge portions 412" and 414".

Opposite the retaining border element 430, the central frame element 428 has a longitudinal profiled border element 444 with two short lips 446 and 446', each protruding towards one of the first 416 and second 422 frame elements. Each of the first 416 and second 422 frame elements comprises an extended lip 448, resp. 448', protruding on their rear side, adapted to engage with the corresponding short lip 446, resp. 446', of the profiled border element 444 when the corner profile 410 is compressed.

Preferred materials for the rigid parts of the presented embodiments (FIGS. 1 to 9), i.e. first, second frame elements, as well as the central frame element and the spacing structure, are polymethyl methacrylate and polycarbonate. The elastic parts, i.e. the transverse and connecting webs interconnecting the frame elements, are preferably made of an olefin thermoplastic polymer. It is to be noted that the presented connecting profiles and corner profile can be manufactured by co-extrusion processes, which are relatively simple to implement and quick.

The invention claimed is:

1. An extruded connecting profile for two panels having peripheral edges, said connecting profile comprising:

a first frame element having a front side and an opposite rear side, said front side being shaped for engaging a peripheral edge with chamfered edges of a first panel of said two panels;

a second frame element having a front side and an opposite rear side, said front side being shaped for engaging a peripheral edge with chamfered edges of a second panel of said two panels, which is adjacent to said peripheral edge of said first panel; and an elastic structure extending between said first and second frame elements, said elastic structure being co-extruded with said first and second frame elements and consisting of a material having a higher elasticity than the material of said first and second frame elements, and said elastic structure comprising two transverse webs, each of them joining said rear side of said first frame element to said rear side of said second frame element; wherein said first and second frame elements are essentially parallel to each other;

each of said first and second frame elements has a pair of longitudinal profiled border elements, said profiled border elements each defining an oblique border surface on said front sides, so that said front sides are adapted to engage said chamfered corners; and each of said profiled border elements comprises a lip protruding on the rear side of said first frame element and said second frame element respectively.

2. The extruded connecting profile according to claim 1, wherein said transverse webs are symmetrically arranged.

3. The extruded connecting profile according to claim 1, wherein said lips of said profiled border elements of said first frame element are adapted to engage with said lips of said profiled border elements of said second frame element, when said extruded connecting profile is compressed.

4. The extruded connecting profile according to claim 1, wherein said first and second frame elements are made of polymethyl methacrylate or polycarbonate and said elastic structure is made of an olefin thermoplastic polymer.

5. An extruded connecting profile for a multiple panel structure comprising:

a first extruded connecting profile to be mounted between a first pair of adjacent panels, said first extruded connecting profile comprising:

a first frame element having a front side and an opposite rear side, said front side being shaped for engaging a peripheral edge with chamfered corners of a first panel of said first pair of panels;

a second frame element having a front side and an opposite rear side, said front side being shaped for engaging a peripheral edge with chamfered corners of a second panel of said first pair, which is adjacent to said peripheral edge with chamfered corners of said first panel; and an elastic structure extending between said first and second frame elements, said elastic structure being co-extruded with said first and second frame elements and consisting of a material having a higher elasticity than the material of said first and second frame elements, and said elastic structure comprising two transverse webs, each of them joining said rear side of said first frame element to said rear side of said second frame element;

wherein said first and second frame elements being essentially parallel to each other;

each of said first and second frame elements has a pair of longitudinal profiled border elements, said profiled border elements each defining an oblique border surface on said front sides, so that said front sides are adapted to engage said chamfered corners; and each of said profiled border elements comprises a lip protruding on the rear side of said first frame element and said second frame element respectively, a second extruded connecting profile to be mounted between a second pair of adjacent panels, parallel to said first pair of panels and spaced therefrom, said second extruded connecting profile comprising:

a first frame element having a front side and an opposite rear side, said front side being shaped for engaging a peripheral edge with chamfered corners of a first panel of said second pair of panels;

a second frame element having a front side and an opposite rear side, said front side being shaped for engaging a peripheral edge with chamfered corners of a second panel of said second pair of panels, which is adjacent to said peripheral edge with chamfered corners of said first panel; and an elastic structure extending between said first and second frame elements, said elastic structure being co-extruded with said first and second frame elements and consisting of a material having a higher elasticity than the material of said first and second frame elements, and said elastic structure comprising two transverse webs, each of them joining said rear side of said first frame element to said rear side of said second frame element;

wherein said first and second frame elements being essentially parallel to each other;

each of said first and second frame elements has a pair of longitudinal profiled border elements, said profiled border elements each defining an oblique border surface on said front sides, so that said front sides are adapted to engage said chamfered corners; and each of said profiled border elements comprises a lip protruding on the rear side of said first frame element and said second frame element respectively; and a spacing structure connecting said first extruded connecting profile and said second extruded connecting profile in-between said first and second pairs of panels.

6. The extruded connecting profile according to claim 5, wherein said spacing structure is connected at one end to a first frame element of the first connecting profile and is connected at the other end to a first frame element of the second connecting profile.

7. An extruded corner profile for two panels forming a corner, said extruded corner profile comprising:

a first frame element having a front side and an opposite rear side, said front side being shaped for engaging an outer edge portion of a peripheral edge of a first panel of said two panels;

a second frame element having a front side and an opposite rear side, said front side being shaped for engaging an outer edge portion of a peripheral edge of a second panel of said two panels, said peripheral edge of said second panel being adjacent to said peripheral edge of said first panel;

a central frame element in-between said first and second frame elements, said central frame element comprising about an inner end a longitudinal retaining border element for engaging inner edge portions of said peripheral edges of said first and second panels, wherein said first and second frame elements are each connected to said central frame element by means of connecting webs, which are co-extruded with said first, second and central frame elements and which are made of a material having a higher elasticity than that of said first, second and central frame elements;

wherein said peripheral edges of said first and second panels comprise chamfered corners;

each of said first and second frame elements comprises a longitudinal profiled border element adapted to engage a chamfered outer edge portion wherein each of said longitudinal profiled border elements of said first and second frame elements comprises a lip protruding on the rear side of said first frame element, respectively said second frame element; and said central frame element comprises a longitudinal profiled border element opposite said inner end, having a first lip protruding towards said border element of said first frame element and a second lip protruding towards said border element of said second frame element.

8. The extruded corner profile according to claim 7, wherein said first, second, and central frame elements are made of polymethyl methacrylate or polycarbonate and said elastic structure is made of an olefin thermoplastic polymer.

* * * * *